US007928342B2

(12) United States Patent
Kirby

(10) Patent No.: US 7,928,342 B2
(45) Date of Patent: Apr. 19, 2011

(54) METAL SHEATHED HEATER WITH SOLID STATE CONTROL DEVICE

(75) Inventor: Robert Kirby, Sparta, TN (US)

(73) Assignee: Tutco, Inc., Cookeville, TN (US)

( * ) Notice: Subject to any disclaimer, the term of this patent is extended or adjusted under 35 U.S.C. 154(b) by 127 days.

(21) Appl. No.: 12/073,069

(22) Filed: Feb. 29, 2008

(65) Prior Publication Data

US 2008/0245782 A1 Oct. 9, 2008

(51) Int. Cl.
*F23Q 13/00* (2006.01)
*H05B 3/02* (2006.01)

(52) U.S. Cl. ..... 219/262; 219/507

(58) Field of Classification Search ..... 219/262, 219/263–519
See application file for complete search history.

(56) References Cited

U.S. PATENT DOCUMENTS

| | | | | |
|---|---|---|---|---|
| 4,692,596 | A * | 9/1987 | Payne | 219/448.12 |
| 4,788,398 | A * | 11/1988 | Hornung | 219/483 |
| 5,786,568 | A * | 7/1998 | McKinney | 219/400 |
| 6,844,531 | B2 | 1/2005 | Kirby | |
| 2005/0194377 | A1 | 9/2005 | Kirby | |
| 2006/0191904 | A1 | 8/2006 | Kirby | |

FOREIGN PATENT DOCUMENTS

| | | |
|---|---|---|
| CA | 1209628 | 8/1986 |
| CA | 1171898 | 7/2004 |
| CA | 2291896 | 1/2006 |

* cited by examiner

*Primary Examiner* — Daniel Robinson
(74) *Attorney, Agent, or Firm* — Clark & Brody

(57) ABSTRACT

A metal sheathed heater includes a solid state control device that allows the metal sheathed heater to be more efficiently operated. The control device supplies or terminates power to the heater according to certain conditions. Further, the control device uses predetermined time periods to control power to the heater. Thus, the heater is not kept on unnecessarily.

13 Claims, 4 Drawing Sheets

METAL SHEATHED HEATER WITH SOLID STATE CONTROL DEVICE

FIELD OF THE INVENTION

The present invention is directed to a metal sheathed heater with a solid state control device and to the use of the heater and control device in heating applications, particularly compressors and the like.

BACKGROUND ART

The use of metal sheathed heaters is known in the art. Typically, these heaters use resistance heating wherein a resistance heating wire or heater cable is encased in a metal sheath. The metal sheath is in contact with the item or material to be heated. These heaters are often referred to as belly-band, crankcase, compressor, sump heaters and the like. A heater is used to heat refrigeration compressors or air-conditioning compressors. The heater can employ a standard hose clamp or other type of clamping arrangement for attachment to a compressor. The standard hose clamp is cut in two pieces with each piece affixed (welded for example) to opposite ends of the heater's metal sheath.

Assembly of the heater to the compressor is accomplished by engaging the two ends of the clamp as intended and then tightening the assembly around the selected compressor location. This type of heater construction can also be used for heating containers such as barrels, heating pipes, and the like.

The belly-band heater has an insulated electric lead wire exiting at each end of the metal sheath. A frequent requirement in the use of these heaters is for the lead wires to be routed in standard metal conduit. Further, it is often desired that the conduit encloses the lead wires from the point where each lead exits the heater sheath to where the lead wires enter an electrical junction box or boxes.

FIG. 1 shows a typical metal sheathed heater or electric belly-band heater designated by the reference numeral 10 and including hose clamp pieces 1 and 3, and a screw mechanism 5. A metal sheath 7 extends between the two pieces 1 and 3, with the hose clamp pieces attached to the sheath by welding or the like. The metal sheath 7 encases an electrically insulated resistance heating wire or heater cable 9 and includes a fluted strip portion 8, which interfaces with the equipment or material requiring heating.

In these types of metal sheathed heaters, it is known in the industry that the heater cable is composed of resistance wire configured to be spiraled around a flexible core made of an electrically insulated and thermally resistant material, such as fiberglass or other suitable material. This element is commonly referred to as a "heater core wire". After the heater core wire is uniformly coated with an insulating material having sufficient mechanical and electrical resistance properties so as to remain flexible yet electrically isolated, it may be referred to as a "heater cable". The insulating material is often silicone or a thermosetting plastic with adequate thermal properties for its intended use.

In connecting the heater cable to the lead wires, a small length of insulation is stripped from each end of the heater cable. Two flexible electrically insulated stranded lead wires with a small length of insulation stripped from one end of each wire are electrically connected, one to each end of the heater cable, by crimping or splicing the stripped ends of the heater cable to stripped ends of the lead wires.

The connector used is a properly selected metal splice connector with sufficient temperature resistance, corrosion resistance, mechanical strength and formability to make a secure electrical bond. Referring to FIG. 1, the lead wires 11 are connected to the heater cable using connections that are in turn encased in the metal sheath as is disclosed in published patent application Ser. No. 2005/0194377 to Kirby, owned by the assignee of this application. The connection between the lead wires and heater cable can be made outside the metal sheath if so desired.

These types of heaters, for example, are disclosed in U.S. Pat. No. 6,844,531 to Kirby, which is herein incorporated in its entirety by reference. Another feature of these types of heaters is a special lead wire joining technique and thermostat arrangement, which are found in the above-mentioned published patent application Ser. No. 2005/0194377 as well as published patent application Ser. No. 2006/0191904 to Kirby, each incorporated by reference herein in their entirety.

Electric resistance compressor heaters, when installed on a compressor that is part of a total system or controlling unit, remain constantly powered regardless of conditions as long as the controlling unit that the heater serves demands power. During certain periods, conditions occur for which the electric resistance compressor heater does not need to operate even though the controlling unit demands power. As a result electrical energy is consumed, which wastes resources and increases energy costs. The use of positive temperature coefficient resistance heaters for heating compressors only partially reduces the use of electrical energy and is not a solution to this problem. Thus, there is a need for improved control of the operation of the types of heaters disclosed above.

Solid-state controls that work in conjunction with sensors (for example temperature sensors) to regulate the power delivered by a heating system are known. Such devices are available on a commercial basis. However, there are no solid-state devices known for controlling electric compressor heaters that monitor conditions and then in turn either switch the heater off and then on again or modulate the power output of the heater to match requirements.

SUMMARY OF THE INVENTION

The present invention responds to the need for improved energy usage and a reduction of the waste of resources by the use of a solid state control device that allows power being supplied to the heater to be controlled so that the heater does not waste energy at times when heating is not needed.

Thus, the embodiments of the present invention disclose a solid state control device for a metal sheathed electric resistance heater that includes an electronic module featuring a programmable integrated circuit (IC), an opto-isolator, and a triac or relay switch device. The electronic module also may include an timer as needed.

The embodiments of the present invention also disclose an electrical resistance compressor heater assembly using the solid state control device. The assembly is controlled by the solid state control device, which may be attached or mounted remote to the heater. The assembly also may have the solid state control device sealed to prevent the entrance of moisture.

The disclosed assembly also may include a configuration wherein a lead wire of the heater is adequately crimped to a lead wire of the solid state control device. The leads may be of sufficient length for use with the assembly. The solid state control device also may include a means for mounting in the assembly. The assembly also includes a joint sealed that is mechanically strong, abrasion resistant, sealed electrically, temperature resistant and sealed to prevent moisture penetration.

The seal may be formed by a thermally activated adhesive with a mechanically strong and abrasion resistant cover being a heat shrinkable tube also serving as a carrier of the thermally activated adhesive. The seal also may be formed by a molding or potting compound and the mechanically strong and abrasion resistant cover being a heat shrinkable tube. Further, the seal also may be formed by a sufficiently thick, tough, mechanically strong and abrasion resistant sealer or potting material.

The assembly of the present invention also may have the solid state control device remotely mounted. Further, the assembly may include that solid state control device having means for appropriate electrical connection or connections to the compressor heater. Alternatively, the assembly of the present invention may have the solid state control device attached to the heater so as to sense a condition to activate.

Thus, according the disclosed embodiments, a heating device apparatus is disclosed. The apparatus includes a heater having an electrical resistance wire sheathed in metal for heating a material. The apparatus also includes a control device to terminate power to the heater upon a condition and supply the power after termination based on another condition.

According to the disclosed embodiments, a method of heating a material also is disclosed. The method includes controlling power to a heater having an electrical resistance wire encompassed in a metal sheath by sensing a first condition using a control device. The first condition indicates heating would not be required. The method also includes terminating the power to the heater. The method also includes supplying the power to the heater for heating the material upon occurrence of a second condition.

According to the disclosed embodiments, a control device for a heating assembly having an electrical resistance wire heater is disclosed. The control device includes an integrated circuit having a sensor interface to determine a first condition or a second condition. The control device also includes a relay device for terminating power to the heater upon occurrence of the first condition and to supply the power to the heater upon occurrence of a second condition. The integrated circuit triggers the relay device according to the first condition or the second condition.

According to the disclosed embodiments, a heating device assembly also is disclosed. The heating device assembly includes a metal sheathed electric resistance heater for heating a material. The heating device assembly also includes a control device to terminate power to the heater based upon a first condition or to supply the power to the heater based on a second condition. The control device includes a programmable integrated circuit having a sensor interface. The sensor interface receives a control signal based on the first condition or the second condition. The control device also includes a relay device triggered by the programmable integrated circuit due to the presence or absence of the control signal to supply or to terminate the power to the heater. The control device also includes an opto-isolator to supply voltage to the relay device and the programmable integrated circuit. The heating device assembly also includes a wire to couple the control device to the heater. The wire delivers the power to the heater.

BRIEF DESCRIPTION OF THE DRAWINGS

The accompanying drawings are included to provide further understanding of the embodiments of the present invention, and are incorporated in and constitute a part of this specification. The drawings together with the description serve to explain the principles of the embodiments of the present invention. In the drawings.

DESCRIPTION OF THE PREFERRED EMBODIMENTS

Reference will now be made in detail to the preferred embodiments of the present invention. Examples of the preferred embodiments are illustrated in the accompanying drawings.

Figure 2:
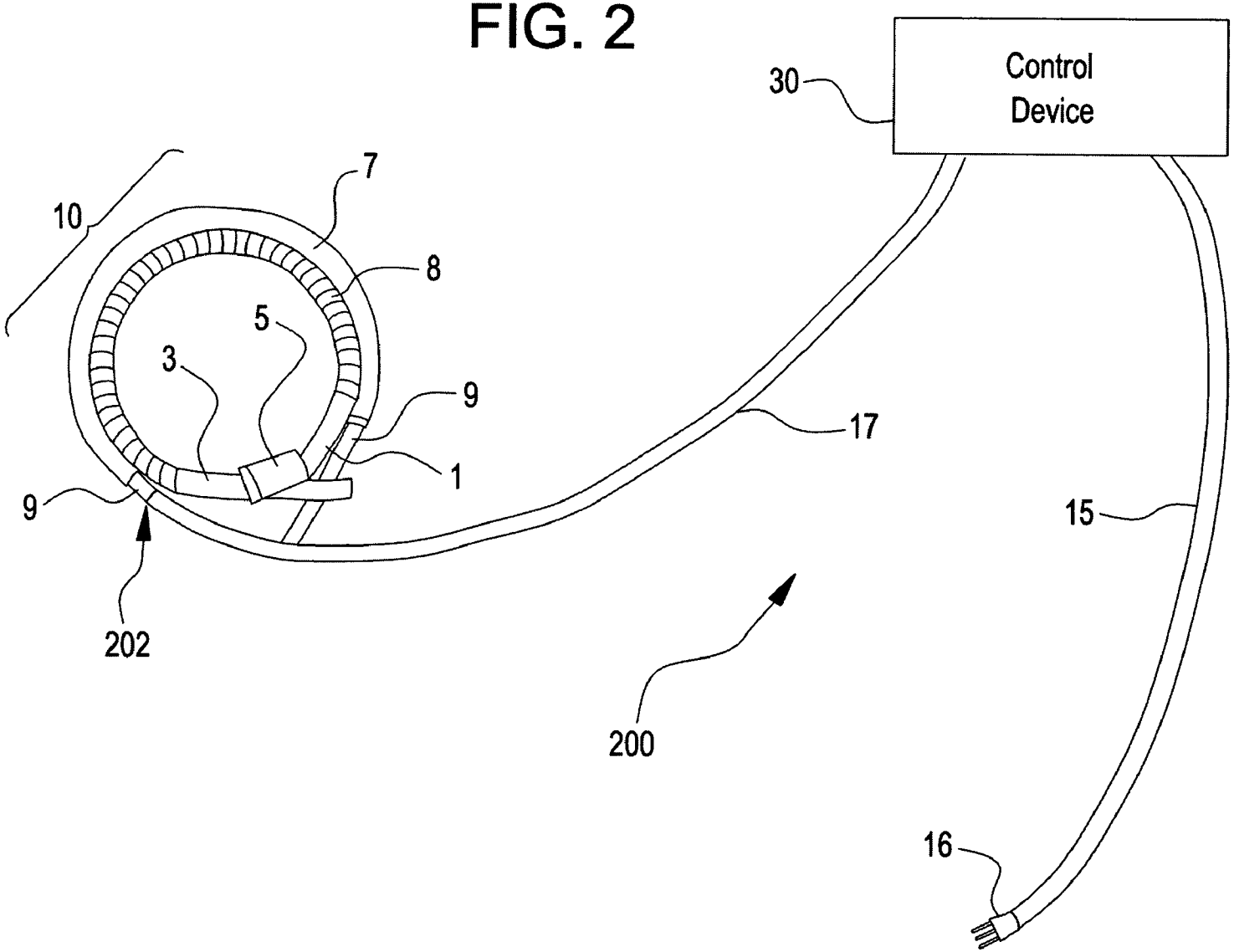
FIG. 2 illustrates a heater assembly with a control device according to the present invention.

FIG. 2 illustrates an embodiment of the inventive solid state control device for use with a metal sheathed heater. The inventive device may be combined with an electrical resistance heater such as a compressor heater, (a TUTCO, Inc. model CH compressor heater), which is well known in the art either electrically connected to the compressor heater by means of a mechanically strong, abrasive resistant, moisture resistance, electrical insulating joint or by some other means.

Figure 1:
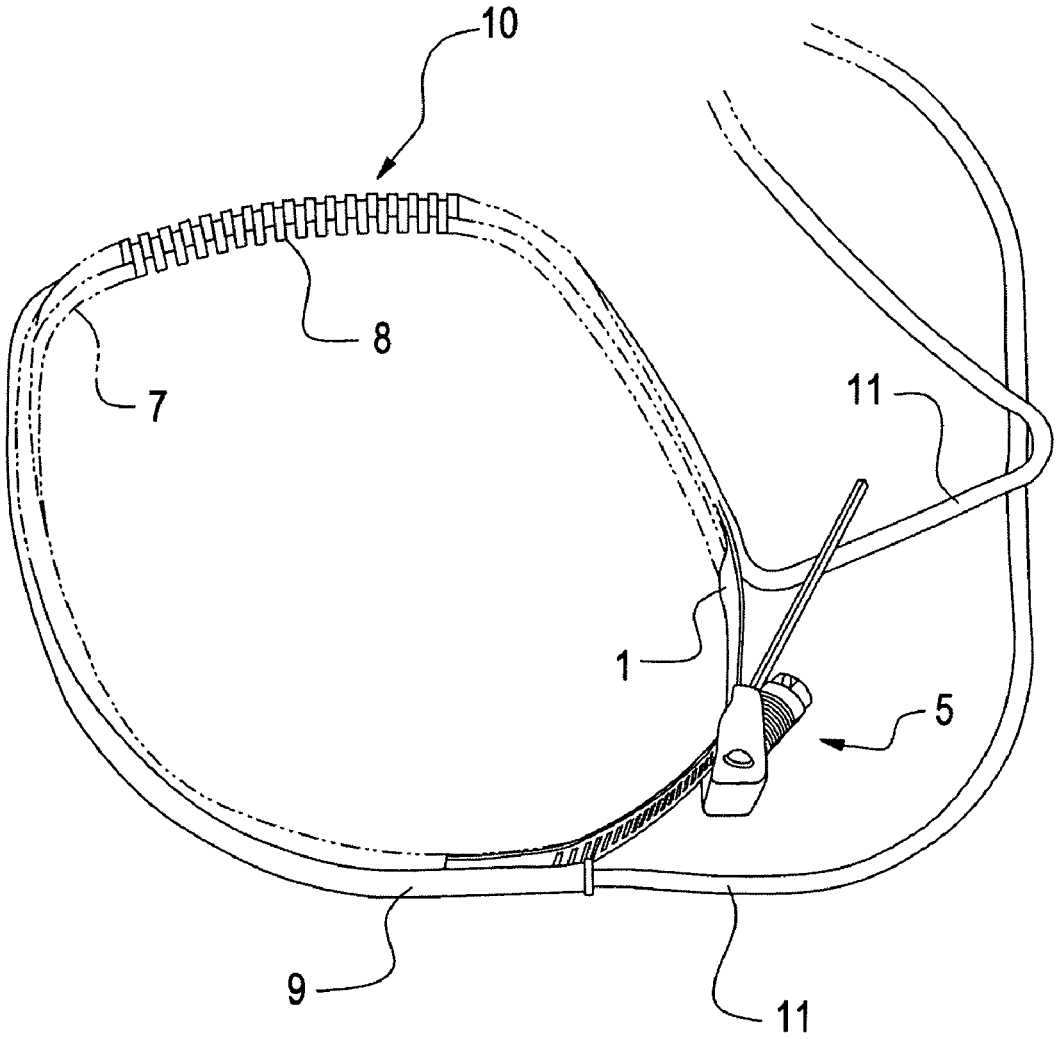
FIG. 1 PRIOR ART
FIG. 1 illustrates a perspective view of a prior art electric metal sheathed heater.

Referring to FIG. 2, a heater assembly 200 is shown. Heater assembly 200 includes heater 10, as disclosed in FIG. 1 above. Features of heater 10 disclosed in FIG. 1 have the same references numerals, except where otherwise noted. Preferably, heater 10 includes an electrical resistance wire sheathed in metal for heating a material.

Heater assembly 200 also includes control device 30 connected to heater 10. Through lead wires 15 and 17, control device 30 regulates output power to heater 10. Lead wire 15 from control device 30 ends in a terminal 16. Terminal 16 connects lead wire 15 to a power source. Lead wire 17 connects control device 30 to heater 10.

Lead wire 17 connects to heater cable 9 via joint 202. Joint 202 may be located within or outside of metal sheath 7. The components of 202 joint may be found in the patent publication Ser. No. 2005/0194377 noted above. Other means may be used to cover joint 202. One example is to first seal joint 202 with a waterproof, temperature resistant, electrical resistant seal or potting material, then use a heat shrinkable tube as described above, with or without an adhesive on its inside surface, to cover joint 202. Additionally, sufficiently thick, water proof, temperature resistant, electrical resistant, mechanically strong seal or potting material may be used to cover joint 202.

Thus, power is supplied to heater 10 via control device 30. When terminal 16 is connected to the power source, control device 30 allows output power to heater 10 through lead wire 17. As disclosed in greater detail below, control device 30 also terminates output power to heater 10 under certain conditions, such that no power is provided to heater cable 9. Thus, heater 10 is not in a continuous "on" state to supply heat wastefully, or when it is not needed.

For example, control device 30 terminates power to heater 10 based upon a sensed condition. The sensed condition may be a point in time, a temperature and the like. Thus, heater 10 is off for a period of time because no output power from control device 30 is received at heater cable 9. Upon another sensed condition, control device 30 supplies output power to the heater 10 because the heat is needed. The first sensed condition and the second sensed condition may correspond to each other, such as time values, or temperature readings.

Figure 3B:
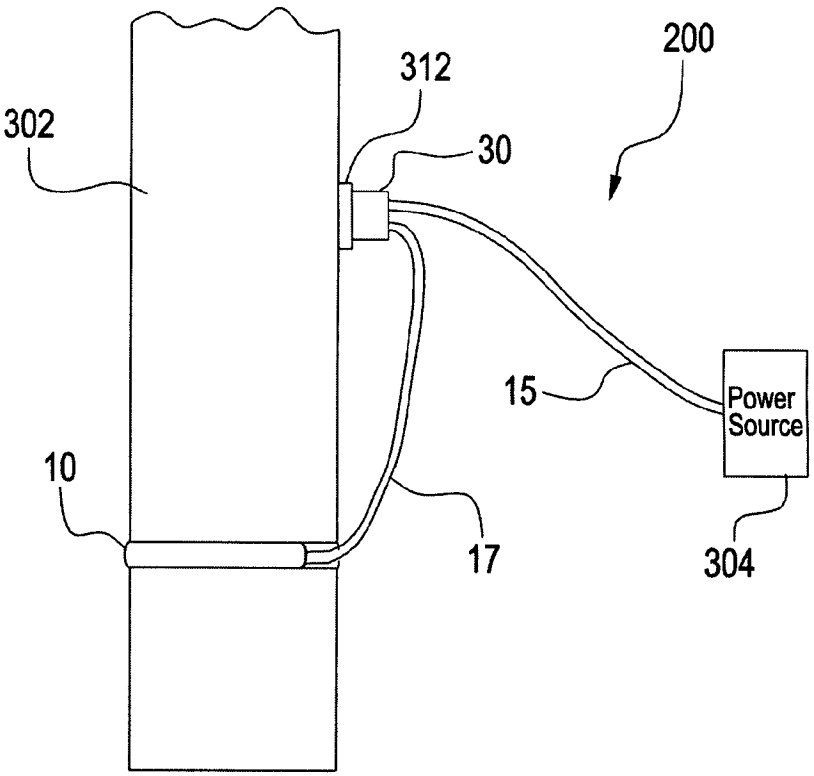
FIGS. 3A and 3B illustrate different configurations of the heater assembly when it is attached to a compressor according to the present invention.
Figure 3A:
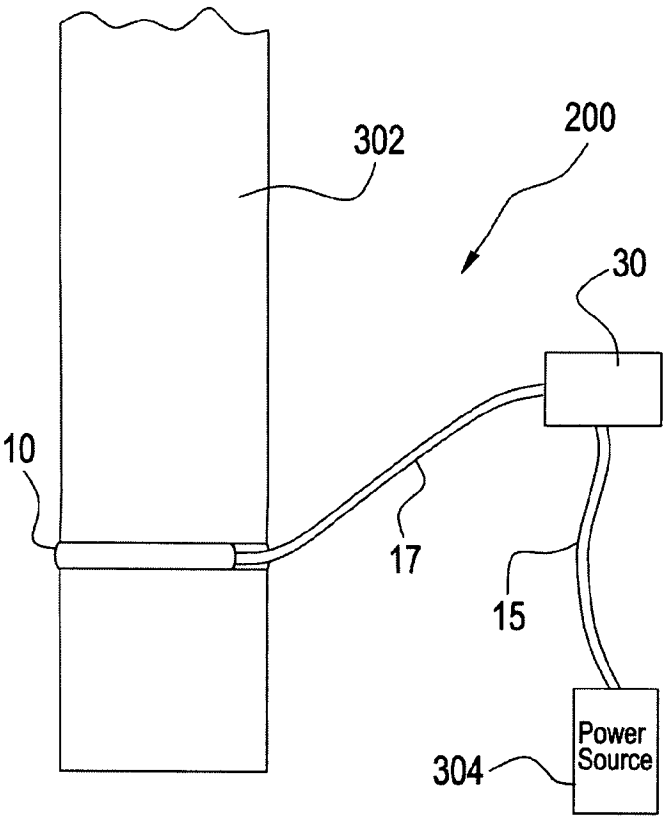

FIGS. 3A and 3B depict different configurations of heater assembly 200 when it is attached to a compressor 302. Metal sheathed heater 10 could also be combined with some other structure for placement and support. The structure, or material held by the structure, requires heating using metal sheathed heater 10.

Lead wires 15 and 17 of heater assembly 200 should be of sufficient length to allow control device 30 to be positioned so as to reach heater 10 without being adversely impacted by compressor 302. For example, referring to FIG. 3A, lead wire 17 allows control device 30 to be located at a distance from compressor 302. Preferably, the distance is not long. Lead wire 15 also is long enough to reach a power source 304. Power source 304 may supply input power as known in the art. For example, power source 304 may be a wall outlet, a battery, generator and the like.

Further, control device 30 may be equipped with an appropriate means for mounting as required in a given installation. Control device 30 may be mounted virtually anywhere in connection with the structure being heated, e.g., the surrounding supports for the structure being heated. Referring to FIG. 3A, control device 30 may be mounted on a wall, post, stand or rest on a table in the vicinity of compressor 302.

For example, mounts for control device 30 may include a plate to hold control device 30 attached by screws, nails, adhesive, glue and the like. Alternatively, control device 30 may be attached directly to a wall or post using screws, nails, adhesive, glue, string wrapped around a post, and the like. For use on a table, shelf and the like, a holder may prop control device 30 into an upright position for easier viewing. The holder also may be attached to the table, shelf and the like using any of the means disclosed above.

An alternate construction is to mount control device 30 to the structure being heated and connect it to heater 10 at the application by conventional termination means. Referring to FIG. 3B, heater assembly 200 is configured with control device 30 mounted on compressor 302. A mount 312 secures control device 30. Mount 312 may be any known mounting device known in the art. For example, mount 312 may be a plate having an adhesive strip on its back to attach to compressor 302. Alternatively, mount 312 may be a plastic or metal holder with straps or a belt that wraps around compressor 302 or is held in place by pegs or the like attached to compressor 302 with glue or adhesive. Lead wires 15 and 17 include lengths to reach power source 304 and heater 10, respectively.

This configuration may be desirable when heater 10 is attached to compressor 302 on a long-term or permanent basis. Control device 30 remains close enough to heater 10 and compressor 302 to take accurate readings for determining whether to supply power via lead wire 17. Further, control device 30 is located in a position to be turned on and off manually.

Figure 4:
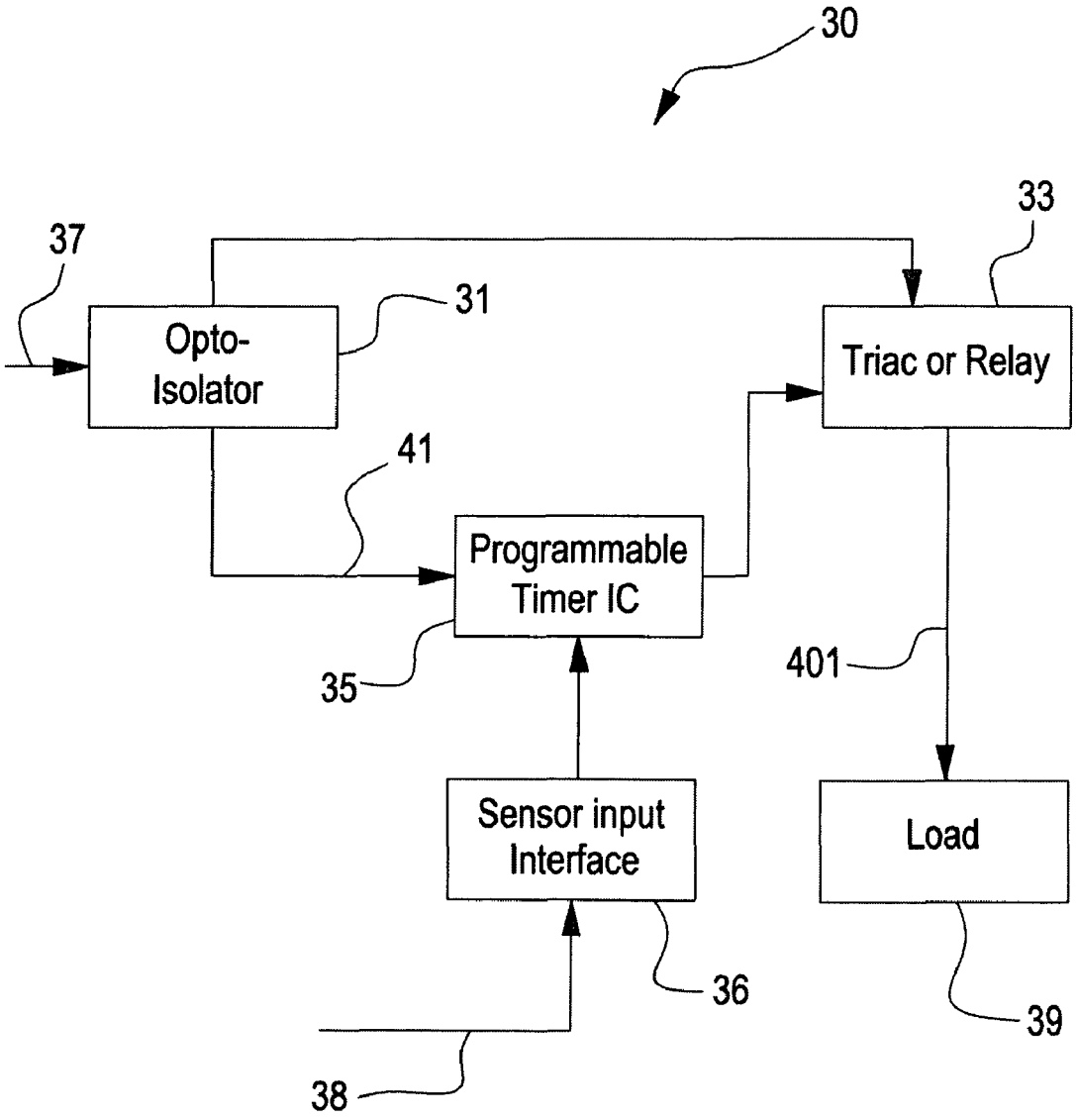
FIG. 4 illustrates a block diagram illustrating components of a control device according to the disclosed embodiments.

FIG. 4 depicts a block diagram illustrating components of control device 30 according to the disclosed embodiments. According to the preferred embodiments, control device 30 is a solid state control device. Control device 30 may include a solid state relay component that acts as a switch. Control device 30 acts like switch that uses low voltage to switch from an input power to an output power to heater 10. In this embodiment, control device 30 does not have moving parts or mechanical contacts in operation, and switches "on" and "off" faster than a mechanical relay.

Referring to FIG. 4, the solid state control device 30 includes an opto-isolator 31, a relay device 33, and a programmable integrated circuit (IC) 35 that has a sensor interface 36. Preferably, the relay device 33 is a triac, but any type of device, solid state or electromechanical, which can function in a relay capacity, could be used.

The opto-isolator 31, also known as an optical coupler or optocoupler, is a semiconductor device that allows signals to be transferred between circuits or systems, while keeping those circuits or systems electrically isolated from each other. Opto-isolators are used in a wide variety of communications, control, and monitoring systems.

Power is supplied to control device 30 at off-line supply 37 and output power to the metal sheathed heater 10 is designated as the load 39. The input power includes a voltage at supply 37 that may be alternating current (AC). Preferably, the voltage component of the input power is about 5 volts. The output power 401 supplied to load 39, or heater 10, includes a voltage component of about 240 volts.

In one mode, the programmable integrated circuit (IC) 35 includes a timer. Programmable IC 35 is powered by the off-line supply 37, which is electrically separated from programmable IC 35 and its control signal input via the opto-isolator 31. Programmable IC 35 is initialized by the deactivation of a control voltage input 38 to the sensor interface 36. Sensor interface 36 is adapted to receive a control signal 38 based on a sensed condition. Programmable IC 35 uses 60-cycles to obtain an accurate time-base.

A typical deactivation, or loss of control voltage input, action would be when compressor 302 turns off. After the timer reaches the desired delay count, the programmable IC 35 triggers the onboard triac or relay 33, supplying current to the load 39 and powering the heater 10. The output power 401 to load 39 remains activated until such time as both timer of the IC 35 and relay 33 are reset by the application of the control input signal 38, i.e., the compressor is again powered. The output power 401 to load 39 will remain deactivated as long as the control signal 38 is present, e.g., the compressor is on.

Alternatively, the absence of the control signal 38 supplied to the sensor interface 36 and programmable IC 35 means that the compressor is off so that the heater should be on. Once the compressor is turned off and a certain period of time elapses, the continued absence of the control voltage signal triggers the relay 33 to supply output power 401 to heater 10.

An example of a specific application for the solid state control device 30 would be when the metal sheathed heater 10 is used to heat compressor 302. When the compressor 302 is on, there is no need to run the heater 10. In order to accomplish this, the sensor interface 36 receives the signal 38 that represents the compressor 302 "on" condition or state. With this condition present, the signal 38 is received by the sensor interface 36 and causes programmable IC 35, in turn, to trigger the relay 33 to terminate the output power 401 to the heater 10. If the compressor 302 shuts down, then the signal 38 would cease, thus re-supplying the output power 401 to the heater 10 according to the timer sequence if present.

While the present invention is illustrated so that the absence of the control signal 38 turns the heater 10 on, it could be arranged so that the presence of a control signal (compressor off) turns the heater 10 on, and the absence of a control signal (compressor on) turns the heater 10 off.

Also, the time period for powering the heater 10 could vary from no time lag to any predetermined period of time. In other words, heater 10 could be powered up immediately upon command, or the predetermined period may allow some time to elapse. One purpose of the timed delay when powering the heater 10 is energy efficiency. As explained above, once the compressor 302 shuts down, a period of time elapses until the heater 10 is energized. This period of time uses the inherent heat in the compressor 302 as it cools down rather than the heat supplied from the heater 10 to ensure that the refrigerant does not migrate to the oil.

Once the compressor 302 cools down for a sufficiently long time, then the heater 10 needs to be energized to make sure that the refrigerant does not migrate to the oil. The predetermined time period can vary widely depending on the material being heated using the heater. One example is a 120 minute delay from compressor 302 shut down to heater 10 start up. In instances where energy efficiency is not important, or the cool down period and ambient conditions may be such that heater energization upon compressor 302 shut down would be immediate, the programmable IC 35 can trigger the relay 33 immediately when the control signal 38 is present or absent. Thus, the programmable IC 35 includes a timer to indicate that the relay device 33 is to supply the output power 401 to the heater 10 after a set period of time elapses from a time the sensor interface 36 senses the absence or presence of control signal 38.

The timer within programmable IC 35 may turn control device 30 to an "on" or "off" status. Further, the timer within programmable IC 35 may elapse a predetermined time period on control device 30 to trigger relay device 33 to activate heater 10 on a periodic or repeating basis. Alternatively, the timer within programmable IC 35 may trigger relay device 33 for a certain amount of time until compressor 302 does not need the heat any longer. At that point, relay device 33 may receive a command from the timer to terminate output power to heater 10.

While the compressor operation is one example of a condition to control the heater operation, other conditions could be used as well. For example, ambient temperature could be measured and once a certain temperature is sensed that would indicate that heating is not required, the relay 33 could be triggered to terminate the power to the heater. As noted above, the triggering based on sensed temperature could be based on either the presence or absence of a control signal. Other conditions as would be known in the art could also be employed to control the heating function of the metal sheathed heater 10.

While opto-isolator 31 is shown to control the voltage to the programmable IC, other solid state devices could be employed that would provide the necessary and low voltage, e.g., 5 volts, to the programmable IC 35 from the input power. Likewise, any type of programmable IC that would have the ability to sense and receive the input control signal and trigger the relay device controlling supply of the output power to the heater, as well as having the timing function described above.

The present invention offers significant improvements in the field of metal sheathed heaters, including the heaters themselves, and their methods of use. By the use of the invention, improvements are realized in operation of the metal sheathed heaters in terms of energy usage.

Thus, in conjunction with the invention as disclosed above, features of the invention include the following:

1. A solid state control device for a metal sheathed electric resistance heater.

2. A solid state control device as in 1 consisting of an electronic module featuring a programmable IC, with an optional timer as needed, opto-isolator, and a triac or relay switch device.

3. An electrical resistance compressor heater assembly using the solid state control device.

4. An assembly as in 3 controlled by a solid state control as in 2.

5. An assembly as in 4 with a solid state control attached.

6. An assembly as in 5 with the solid state control mounted remote to the heater.

7. An assembly as in 5 with the solid state control device sealed to prevent the entrance of moisture.

8. An assembly as in 7 with a lead wire of the heater adequately crimped to a lead wire of the solid state control device.

9. An assembly as in 8 with leads of sufficient length for the application.

10. An assembly as in 9 with the solid state control having a means for mounting in the application.

11. An assembly as in 10 with a joint sealed that is mechanically strong, abrasion resistant, sealed electrically, temperature resistant and sealed to prevent moisture penetration.

12. An assembly as in 11 with the seal being formed by a thermally activated adhesive with a mechanically strong and abrasion resistant cover being a heat shrinkable tube also serving as a carrier of the thermally activated adhesive.

13. An assembly as in 12 with the seal being formed by a molding or potting compound and the mechanically strong and abrasion resistant cover being a heat shrinkable tube.

14. An assembly as in 13 with the seal being formed by a sufficiently thick, tough, mechanically strong and abrasion resistant sealer or potting material.

15. An assembly as in 4 with the solid state control remotely mounted.

16. An assembly as in 15 with the solid state control having means for appropriate electrical connection to the compressor heater.

17. An assembly as in 5 with the solid state control attached to the heater so as to sense ambient conditions, such as temperature, the heater or an adjacent component.

As such, an invention has been disclosed in terms of preferred embodiments thereof which fulfills each and every one of the objects of the present invention as set forth above and provides a new and improved metal sheathed heater and method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A heating device apparatus comprising:

a heater having an electrical resistance wire sheathed in metal for heating a material; and a control device to terminate power to the heater upon a first condition, and supply the power after termination based on a second condition, wherein opposing ends of the metal sheathing the electrical resistance wire have a clamp assembly that permits the metal to be secured around a structure for heating the material, wherein the first condition comprises an operation of a compressor and the second condition comprises the non-operation of the compressor, and the control device is configured, during operation of the compressor, to terminate power to the heater and, after the compressor stops operation, to supply power to the heater, either immediately or after a predetermined time period elapses.

2. The heating device apparatus of claim 1, wherein the control device is coupled to the heater with a wire.

3. The heating device apparatus of claim 1, wherein power received at the control device is less than the power supplied to the heater.

4. The heating device apparatus of claim 1, wherein the control device comprises an opto-isolator, a relay device, and a programmable integrated circuit having a sensor interface.

5. The heating device apparatus of claim 4, wherein the programmable integrated circuit includes a timer.

6. The heating device apparatus of claim 4, wherein the sensor interface is adapted to receive a control signal based on the first or second condition.

7. The heating device apparatus of claim 6, wherein a presence or absence of the control signal causes the programmable integrated circuit to trigger the relay device.

8. The heating device apparatus of claim 7, wherein the relay device either supplies or terminates the power to the heater.

9. The heating device apparatus of claim 1, wherein the material being heated is associated with a compressor.

10. The heating device apparatus of claim 4, wherein the opto-isolator delivers a voltage to the programmable integrated circuit.

11. The heating device apparatus of claim 7, wherein the programmable integrated circuit has a timer to indicate that the relay device is to supply the power to the heater after a set period of time elapses from a time the sensor interface senses the absence or presence of the control signal.

12. A heating device apparatus comprising:

a heater having an electrical resistance wire sheathed in metal for heating a material; and a control device to terminate power to the heater upon a first condition, and supply the power after termination based on a second condition, wherein the control device comprises an opto-isolator, a relay device, and a programmable integrated circuit having a sensor interface, and further wherein the opto-isolator delivers a voltage to the programmable integrated circuit.

13. A heating device apparatus comprising:

a heater having an electrical resistance wire sheathed in metal for heating a material; and a control device to terminate power to the heater upon a first condition, and supply the power after termination based on a second condition, wherein the control device comprises an opto-isolator, a relay device, and a programmable integrated circuit having a sensor interface, and further wherein a presence or absence of the control signal causes the programmable integrated circuit to trigger the relay device and the programmable integrated circuit has a timer to indicate that the relay device is to supply the power to the heater after a set period of time elapses from a time the sensor interface senses the absence or presence of the control signal.

* * * * *

UNITED STATES PATENT AND TRADEMARK OFFICE

CERTIFICATE OF CORRECTION

PATENT NO. : 7,928,342 B2
APPLICATION NO. : 12/073069
DATED : April 19, 2011
INVENTOR(S) : Robert Kirby It is certified that error appears in the above-identified patent and that said Letters Patent is hereby corrected as shown below:

Title page, insert the following:

--Related U.S. Application Data:
This application claims the benefit of U.S. Provisional Application No. 60/907,477 filed April 3, 2007--

Signed and Sealed this
Fourteenth Day of February, 2012

David J. Kappos

David J. Kappos
*Director of the United States Patent and Trademark Office*